US005566690A

United States Patent [19]

Shih-Ming

[11] Patent Number: 5,566,690

[45] Date of Patent: Oct. 22, 1996

[54] HAIR CLIP

[76] Inventor: Hsu Shih-Ming, P.O. Box 82-144, Taipei, Taiwan

[21] Appl. No.: 328,511

[22] Filed: Oct. 25, 1994

[51] Int. Cl.[6] ..... A45D 8/00

[52] U.S. Cl. ..... 132/276; 132/273; 132/278; 132/280; 132/222

[58] Field of Search ..... 132/273, 276, 132/278, 280, 275, 246, 222

[56] References Cited

U.S. PATENT DOCUMENTS 1,844,644 2/1932 Eisler ..... 132/246
2,525,981 10/1950 Webster ..... 132/246
2,649,097 8/1953 Chernack ..... 132/246
2,832,358 4/1958 Chambers ..... 132/273
3,542,041 11/1970 Mercorella ..... 132/273

*Primary Examiner*—Gene Mancene
*Assistant Examiner*—Pedro Philogene
*Attorney, Agent, or Firm*—Alfred Lei

[57] ABSTRACT

A hair clip for fastening a hairdo, having a clip body made of flexible material and defining an open space for passing the hair, permitting the hair to be arranged into a hairdo; and a fastening device integrally made on two opposite ends of the clip body for fastening the clip body to the hairdo.

1 Claim, 11 Drawing Sheets

HAIR CLIP

BACKGROUND OF THE INVENTION

The present invention relates to a hair clip for fastening hairdos in shape.

When the hair is arranged into a hairdo, a hairpin or hair clip shall be used to fasten the hairdo in shape. FIG. 13 shows a hairpin according to the prior art for this purpose. However, this hairpin is still not satisfactory in function because it cannot firmly hold down a sophisticated hairdo.

SUMMARY OF THE INVENTION

The present invention has been accomplished to provide hair clips which are suitable for holding down any of a variety of hairdos. According to the present invention, a hair clip comprises a clip body made of flexible material and defining an open space for passing the hair, permitting the hair to be arranged into a hairdo; and a fastening device integrally made on two opposite ends of the clip body for fastening the clip body to the hairdo. The fastening device may be variously embodied. According to one embodiment of the present invention, the fastening device is comprised of two reversed hooks extended from two opposite ends of the clip body in the reversed directions. According to another embodiment of the present invention, the fastening device comprises an arrow-like retainer rod at one end of the clip body, and a retaining hole at an opposite end of the clip body for holding the arrow-like retainer rod. According to still another alternate form of the present invention, the fastening device comprises a male fastening element having raised portions, and a female fastening element having recessed portions for engagement with the raised portions of the male fastening element respectively.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1A:
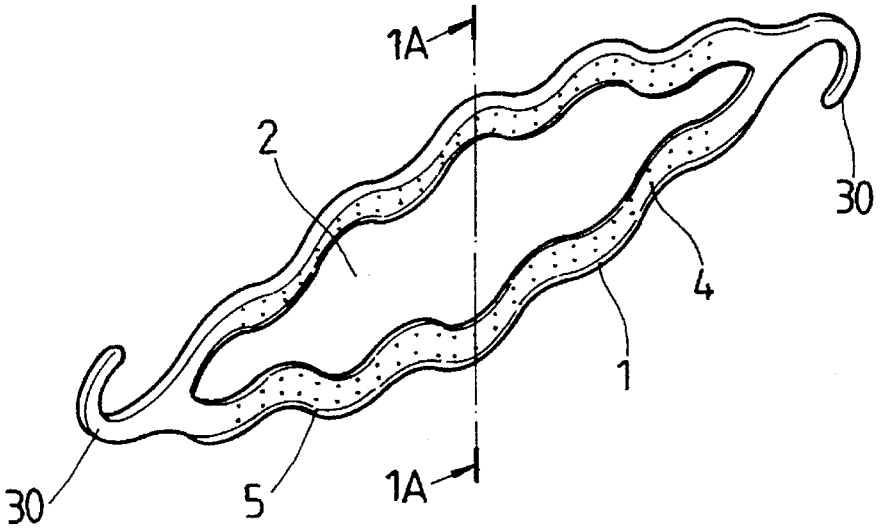
FIG. 1A is an elevational view of a hair clip according to one embodiment of the present invention.
Figure 1B:
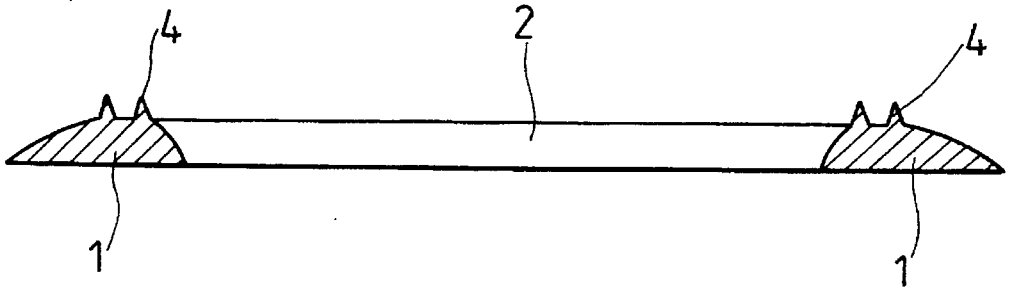
FIG. 1B is a cross section taken along line A—A of FIG. 1.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to FIGS. 1A and lB, a hair clip according to one embodiment of the present invention is comprised of an endless clip body 1 defining an open space 2 for passing the hair, and a fastening device 3 made on two opposite ends of the endless clip body 1. The fastening device 3 is comprised of two hooks 30 respectively extended from the two opposite ends of the clip body 1 in the reversed directions. The hair clip is made from flexible material so that it can be folded up and fastened to the hair by hooking up the hooks 30. The endless clip body 1 comprises a plurality of teeth 4 raised from one side for holding down the hair, and corrugated portions 5 for guiding the hair.

Figure 2:
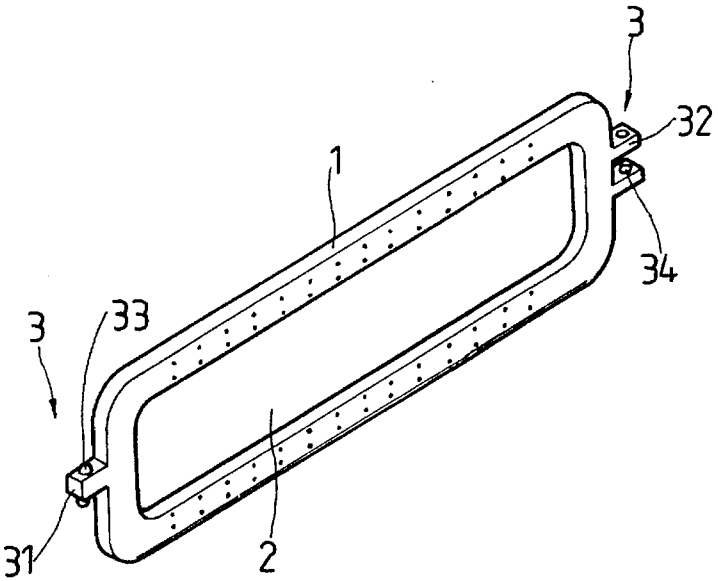
FIG. 2 shows an alternate form of the present invention.

FIG. 2 shows an alternate form of the present invention. According to this alternate form, the hair clip comprises an endless clip body of substantially rectangular shape defining an open space 2 for passing the hair, and a fastening device 3, which is comprised of a male element 31 extended from one end of the clip body 1 and having raised portions 33, and a female element 32 extended from an opposite end of the clip body 1 and having recessed portions 34. When the clip body 1 is folded up to hold the hair, the male element 31 is inserted into the female element 32, permitting the raised portions 33 to be engaged with the recessed portions 34.

Figure 3:
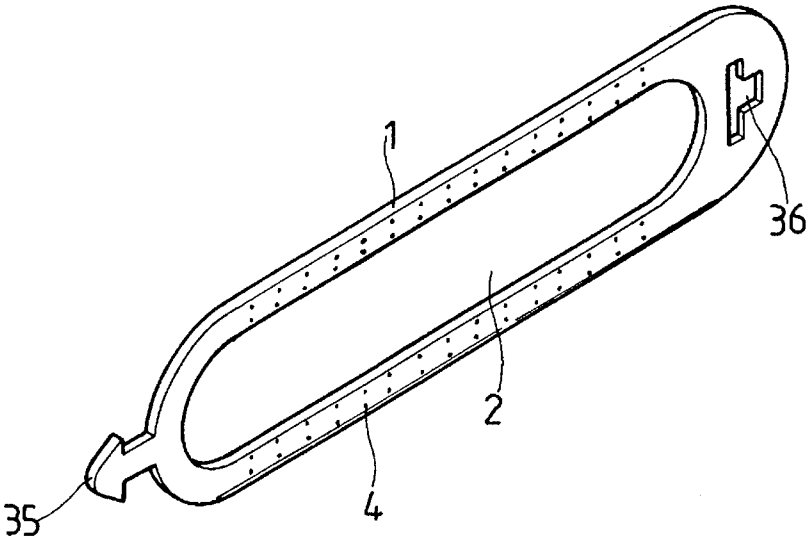
FIG. 3 shows another alternate form of the present invention.

FIG. 3 shows another alternate form of the present invention. According to this alternate form, the clip body 1 is made of oblong shape defining an oblong open space 2 and having a plurality of teeth 4 raised from one side, and the fastening device is comprised of an arrow-like retainer rod 35 disposed at one end of the clip body 1 and a retaining hole 36 disposed at an opposite end of the clip body 1 for holding the retainer rod 35.

Figure 4:
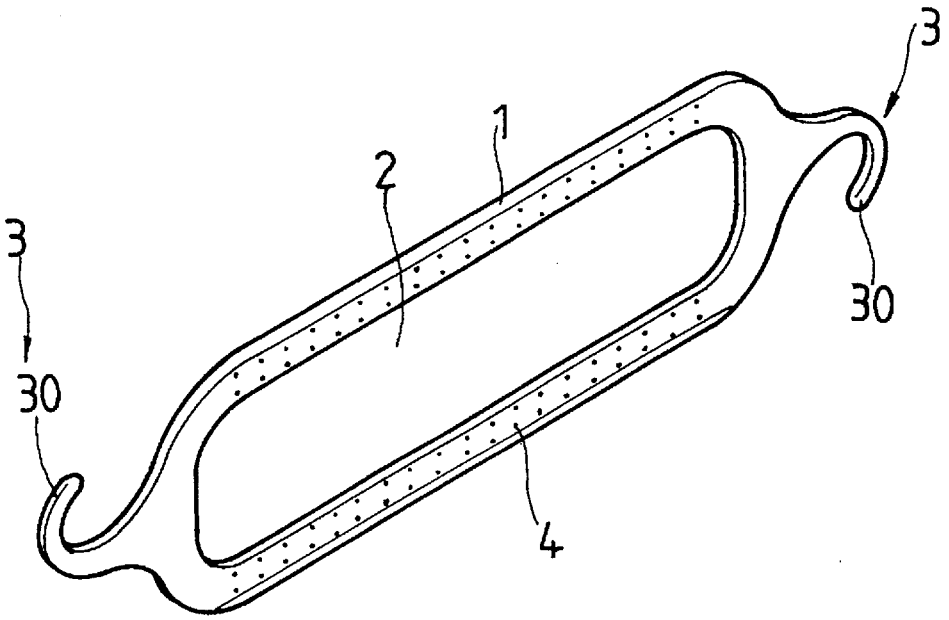
FIG. 4 shows still another alternate form of the present invention.

FIG. 4 shows still another alternate form of the present invention, in which the clip body 1 is made of rectangular shape defining a rectangular open space 2 and having a plurality of teeth 4 raised from one side, and the fastening device 3 is comprised of two reversed hooks 30.

Figure 5:
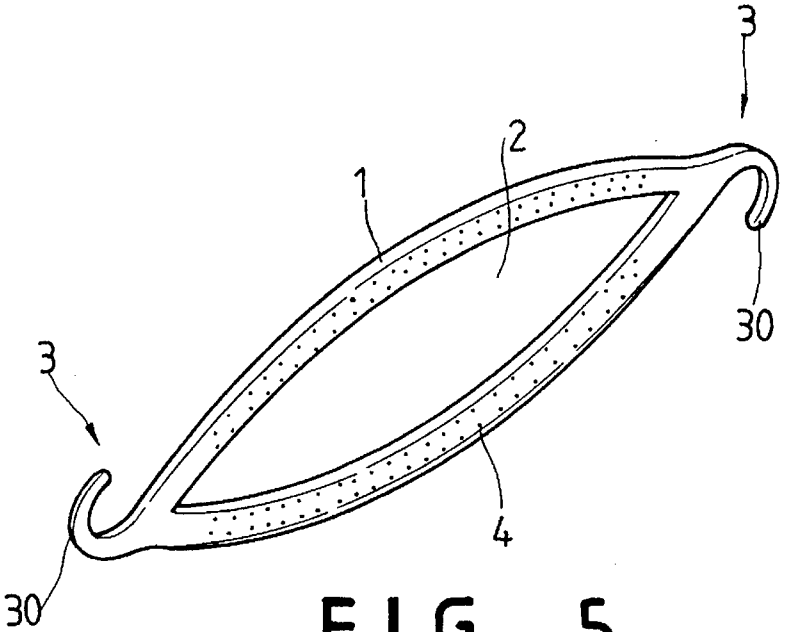
FIG. 5 shows still another alternate form of the present invention.
Figure 7C:
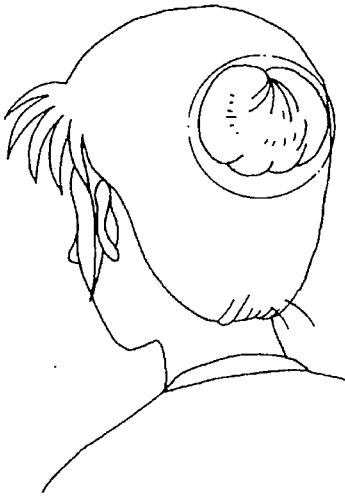
FIGS. 7A, 7B, 7C and 7D show an example of the application of the present invention.
Figure 7D:
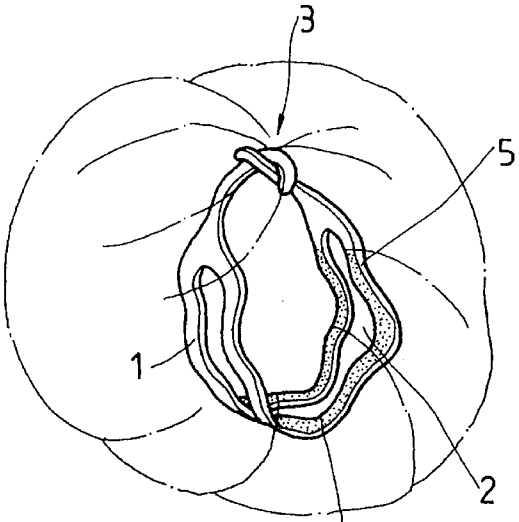
Figure 7B:
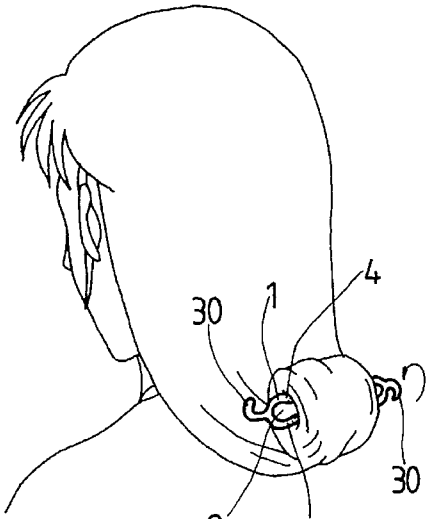
Figure 7A:
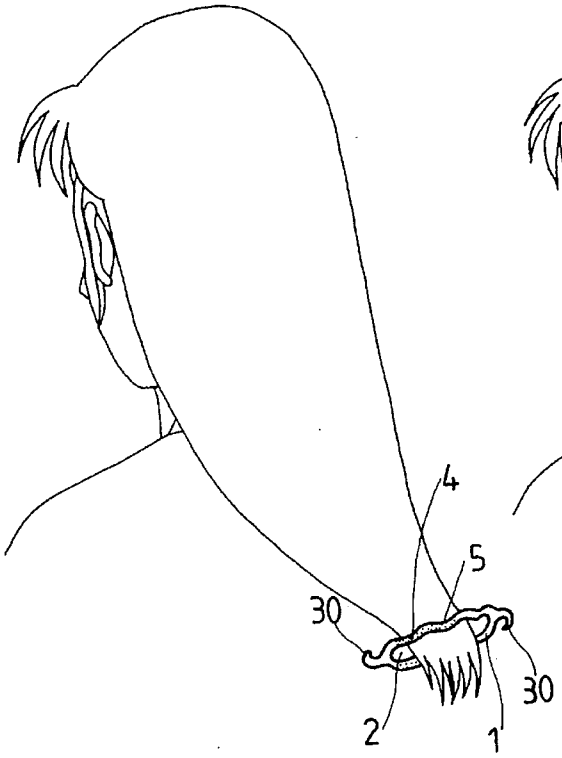
Figures 8A, 8B, 8C:
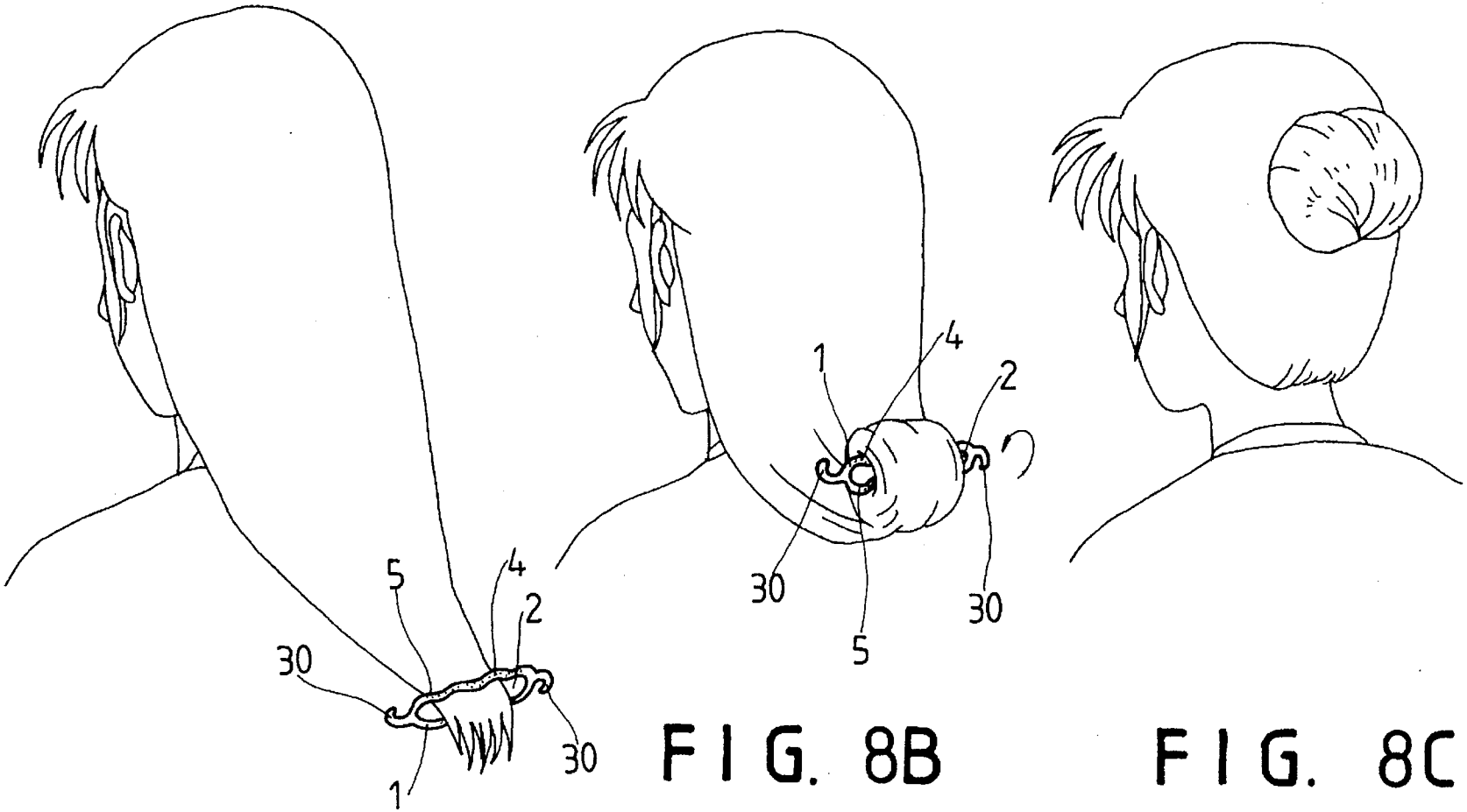
FIGS. 8A, 8B and 8C show another example of the application of the present invention.
Figures 9A, 9B, 9C:
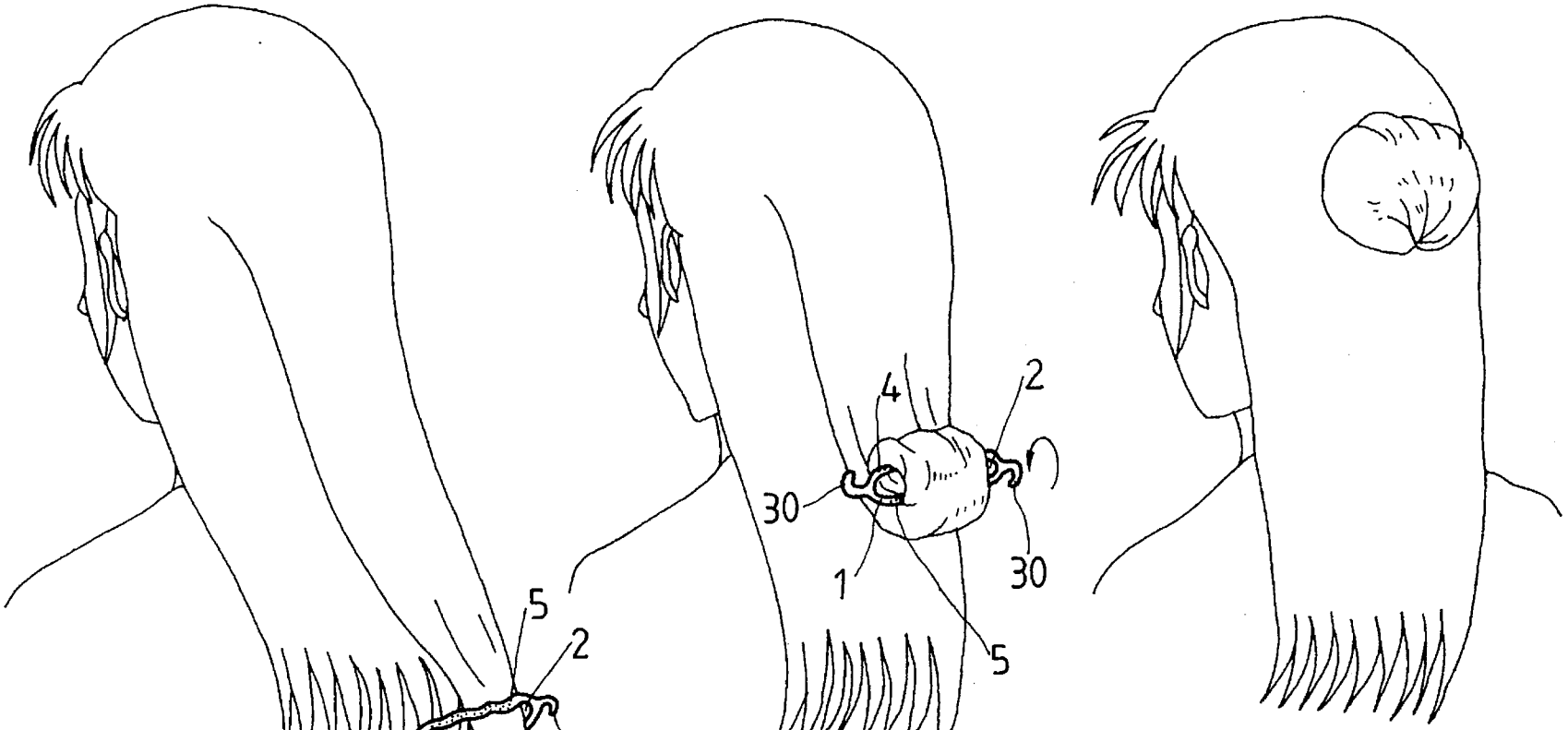
FIGS. 9A, 9B and 9C show still another example of the application of the present invention.
Figures 10A, 10B, 10C:
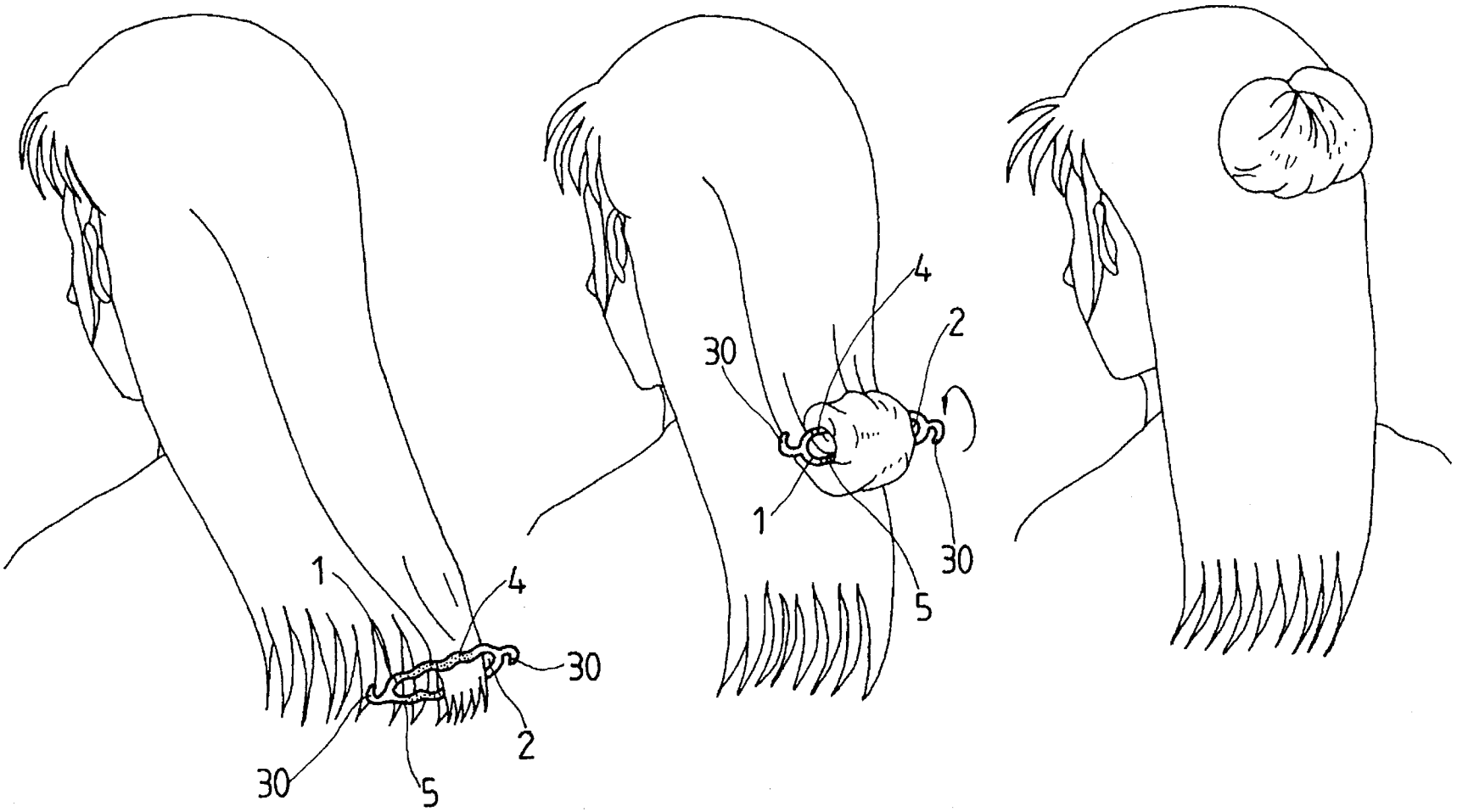
FIGS. 10A, 10B and 10C show still another example of the application of the present invention.
Figure 11B:
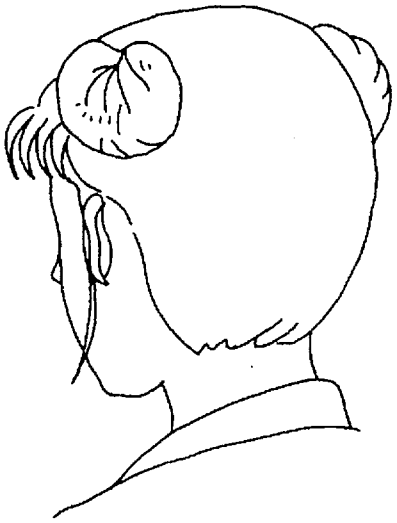
FIGS. 11A and lIB show still another example of the application of the present invention.
Figure 11A:
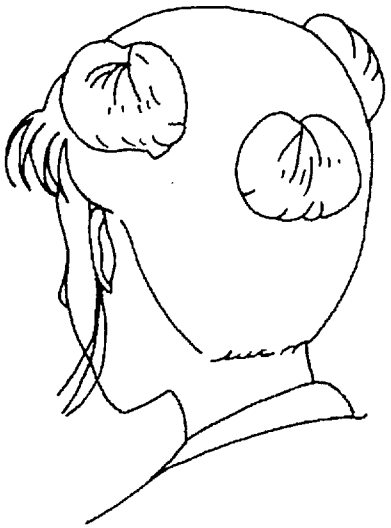
Figure 12B:
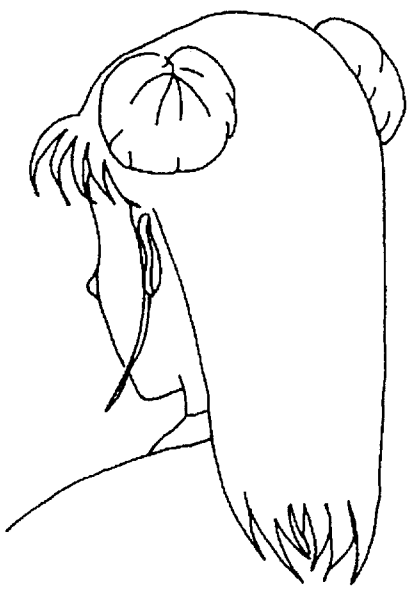
FIGS. 12A and 12B show a yet further example of the application of the present invention.
Figure 12A:
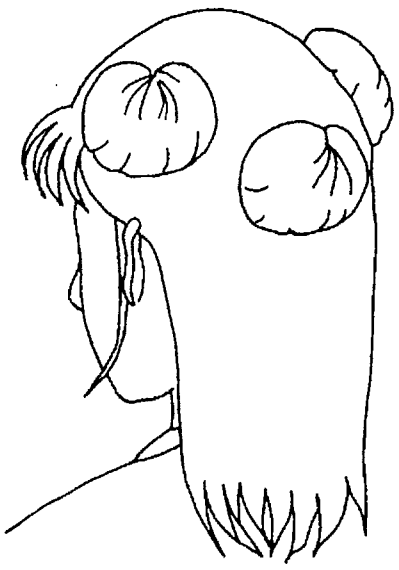
Figure 13:
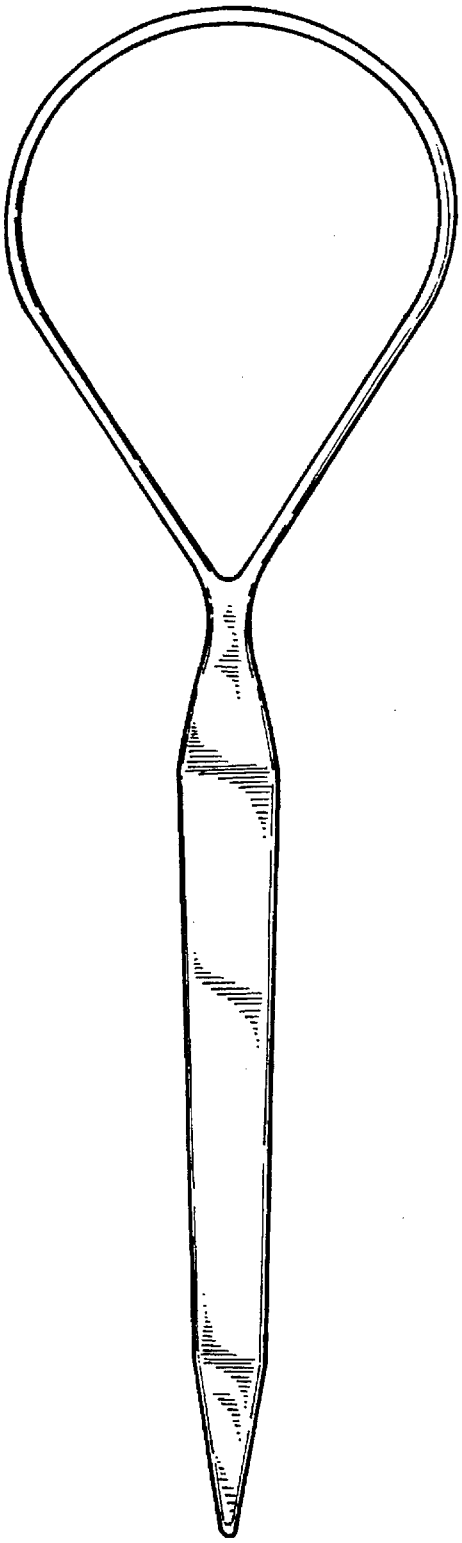
PRIOR ART FIG. 13
FIG. 13 shows a hairpin according to the prior art.

FIG. 5 shows still another alternate form of the present invention, in which the clip body 1 is shaped like a fish eye defining a fish eye-like open space 2 and having a plurality of teeth 4 raised from one side, and the fastening device 3 is comprised of two reversed hooks 30.

Figure 6:
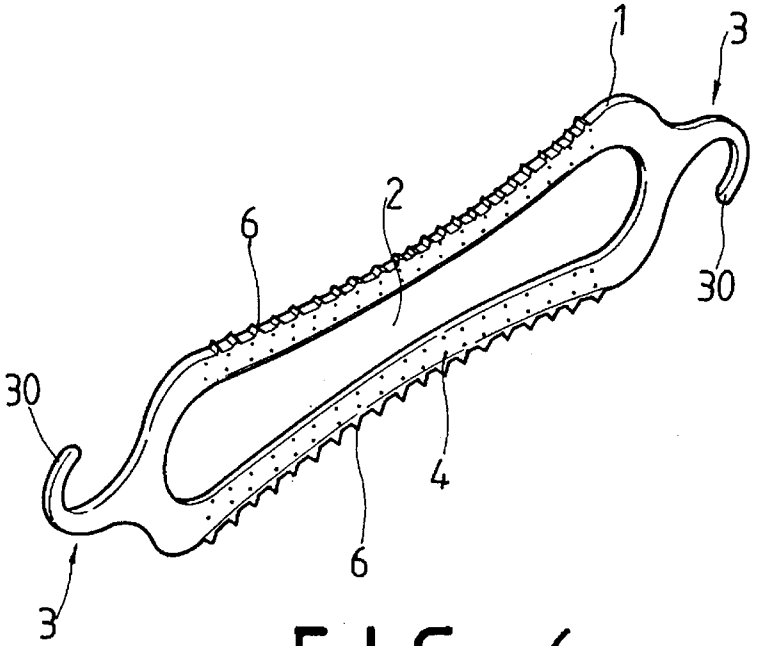
FIG. 6 shows still another alternate form of the present invention.

FIG. 6 shows still another alternate form of the present invention, in which the endless clip body 1 has a plurality of teeth 4 raised from one side and two opposite toothed portions 6 along the periphery; the fastening device 3 is comprised of two reversed hooks 30.

FIGS. 7 through 12 show various examples of the application of the present invention. As illustrated, when the tail of the hair is inserted through the open space 2 of the clip body 1, the clip body 1 is turned to roll up the hair, and then the fastening device 3 is fastened up to hold down the hairdo by hooking up the reversed hooks 30 together, inserting the male element 31 into the female element 32 to let the raised portions 33 be engaged with the recessed portions 34, or fastening the arrow-like retainer rod 35 to the retaining hole 36.

While only few embodiments of the present invention have been shown and described, it will be understood that various modifications and changes could be made without departing from the spirit and scope of the invention.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A hair clip for holding hair into an arranged hairdo, said hair clip comprising:

a clip body made of flexible material having oppositely disposed arcuate first and second side members joined at each to form a passageway for inserting hair therebetween, said joined ends forming a first end portion and a second end portion;

said first side member having a planar surface, said second side member having a planar surface;

said planar surfaces of said first and second side members having a plurality of teeth extending therefrom for holding the hair as the hair is rolled over said clip;

an outer periphery surface on said first and second side members having a plurality of corrugated portions for positioning of the hair evenly along the outer surface;

first and second hooks integrally connected at the first and second end portions, respectfully, of the hair clip body to hold said clip body in a folded position in the hair after the clip is rolled to the desired hairdo.

* * * * *